US007530508B2

(12) United States Patent
Sato et al.

(10) Patent No.: US 7,530,508 B2
(45) Date of Patent: May 12, 2009

(54) FUEL INJECTION VALVE

(75) Inventors: Daisuke Sato, Miyagi (JP); Atsushi Kamahora, Miyagi (JP); Akira Arioka, Miyagi (JP); Ryuji Aoki, Miyagi (JP)

(73) Assignee: Keihin Corporation, Tokyo (JP)

( * ) Notice: Subject to any disclaimer, the term of this patent is extended or adjusted under 35 U.S.C. 154(b) by 178 days.

(21) Appl. No.: 11/797,908

(22) Filed: May 8, 2007

(65) Prior Publication Data

US 2007/0272774 A1 Nov. 29, 2007

(30) Foreign Application Priority Data

May 15, 2006 (JP) ..... 2006-135256

(51) Int. Cl.

| | |
|---|---|
| ***B05B 1/00*** | (2006.01) |
| ***B05B 1/34*** | (2006.01) |
| ***B05B 1/14*** | (2006.01) |
| ***F02M 61/00*** | (2006.01) |
| ***F02M 51/00*** | (2006.01) |
| ***A62C 31/02*** | (2006.01) |

(52) U.S. Cl. ..... 239/596; 239/494; 239/533.2; 239/533.12; 239/552; 239/585.1; 239/601

(58) Field of Classification Search ..... 239/494, 239/522, 533.2, 533.3, 533.12, 552, 585.1, 239/585.4, 592, 596, 598, 601, 900
See application file for complete search history.

(56) References Cited

U.S. PATENT DOCUMENTS

| | | | | |
|---|---|---|---|---|
| 6,854,670 | B2 * | 2/2005 | Sumisha et al. | 239/543 |
| 7,299,997 | B2 * | 11/2007 | Sayar | 239/5 |
| 7,344,090 | B2 * | 3/2008 | Sayar | 239/5 |
| 7,448,560 | B2 * | 11/2008 | Sayar | 239/596 |
| 2003/0141387 | A1 | 7/2003 | Xu | |
| 2003/0234005 | A1 | 12/2003 | Sumisha et al. | |
| 2008/0203194 | A1 * | 8/2008 | Aoki et al. | 239/533.12 |

FOREIGN PATENT DOCUMENTS

| | | | |
|---|---|---|---|
| JP | 2002-130074 | A | 5/2005 |
| WO | WO2005/045232 | A | 5/2005 |

* cited by examiner

*Primary Examiner*—Len Tran
*Assistant Examiner*—Ryan Reis
(74) *Attorney, Agent, or Firm*—Arent Fox LLP

(57) ABSTRACT

In a fuel injection valve, a fuel guide member facing the valve hole is connected to an injector plate, and an annular diffusion chamber is formed between a valve seat member and the injector plate. A pair of first notches, a pair of second notches, and a plurality of closing parts are formed in an outer periphery of the fuel guide member. The first notches are arranged on a first diameter line of the valve hole. The second notches are arranged on a second diameter line perpendicular to the first diameter line. The closing parts are provided between the first and second notches to partially close the valve hole. A plurality of fuel injection holes are dispersally arranged in outside regions corresponding to the closing parts and inside regions corresponding to the first notches. A first tip end corner of the closing part adjacent to the first notch is formed into an edge shape or a minute arc shape, while a second tip end corner of the closing part adjacent to the second notch is formed into a large arc shape. Thus, it is possible to reduce a particle size of injected fuel and improve penetrability.

7 Claims, 10 Drawing Sheets

FUEL INJECTION VALVE

RELATED APPLICATION DATA

The present invention is based upon Japanese priority application No. 2006-135256, which is hereby incorporated in its entirety herein by reference.

BACKGROUND OF THE INVENTION

1. Field of the Invention

The present invention relates to a fuel injection valve used mainly for a fuel supply system of an internal combustion engine. More particularly, the present invention relates to an improvement of a fuel injection valve comprising: a valve seat member which includes a conical valve seat and a valve hole penetrating a central portion of the valve seat; a valve element for opening and closing the valve hole in cooperation with the valve seat; an injector plate which has a plurality of fuel injection holes arranged so as to be displaced radially outward of the valve hole and which is joined to the valve seat member; and a diffusion chamber provided between the valve seat member and the injector plate so as to provide a communication between the valve hole and the fuel injection holes.

2. Description of the Related Art

Such a fuel injection valve is already known as disclosed in Japanese Patent Application Laid-Open No. 2002-130074.

In recent internal combustion engines, low fuel consumption and low pollution are increasingly demanded. When reducing fuel consumption and purifying exhaust gas in a fuel injection valve, it is important to reduce a particle size of injected fuel and obtain penetrability for suppressing adhesion of fuel to an inner wall of an intake passage.

SUMMARY OF THE INVENTION

The present invention has been achieved in view of the above circumstances, and has an object is to provide a simple structured fuel injection valve capable of reducing a particle size of injected fuel and improving penetrability.

In order to achieve the above object, according to a first feature of the present invention, there is provided a fuel injection valve comprising: a valve seat member; a valve element for opening and closing the valve hole in cooperation with the valve seat; an injector plate which has a plurality of fuel injection holes arranged so as to be displaced radially outward of the valve hole and which is joined to the valve seat member; and a diffusion chamber provided between the valve seat member and the injector plate so as to provide a communication between the valve hole and the fuel injection holes. The valve seat member includes a conical valve seat and a valve hole penetrating a central portion of the valve seat. In this fuel injection valve, a fuel guide member facing the valve hole is connected to a central portion of the injector plate. Also, the annular diffusion chamber has a diameter larger than that of the valve hole and is formed between the valve seat member and the injector plate, inner ends of the fuel injection holes being opened in the annular diffusion chamber, an outer peripheral surface of the fuel guide member facing the annular diffusion chamber. Further, a pair of first notches, a pair of second notches, and a plurality of closing parts are formed in an outer periphery of the fuel guide member. The first notches have large notch areas and are opened in directions opposite from each other to provide a communication between the valve hole and the diffusion chamber. The second notches have small notch areas and are opened in directions opposite from each other on a diameter line passing between the pair of first notches to provide a communication between the valve hole and the diffusion chamber. The closing parts are provided between the first and second notches to partially close the valve hole. Furthermore, the plurality of fuel injection holes are divided into two groups arranged on opposite sides of the diameter line, and the plurality of fuel injection holes of each group are dispersally arranged in outside regions corresponding to the closing parts and an inside region corresponding to the first notch. Moreover, a first tip end corner of the closing part adjacent to the first notch is formed into an edge shape or a minute arc shape, and a second tip end corner of the closing part adjacent to the second notch is formed into a large arc shape having a curvature smaller than that of the first tip end corner.

The diameter line in the first feature corresponds to a second diameter line L2 of embodiments of the present invention which will be described later.

According to a second feature of the present invention, in addition to the first feature, the pair of first notches are arranged so as to circumscribe a first imaginary circle concentric with the valve hole; the pair of second notches are arranged so as to circumscribe a second imaginary circle concentric with the first imaginary circle; and when a diameter of the first imaginary circle represents D1, a diameter of the second imaginary circle represents D2, and an outer diameter of the fuel guide member represents D3, the following two equations are established at the same time: (1) D1/D3 or D2/D3≦0.6; and (2) D1/D2≦1.29.

According to a third feature of the present invention, in addition to the second feature, the diameter of the first imaginary circle is smaller than the diameter of the second imaginary circle.

According to a fourth feature of the present invention, in addition to the second feature, the diameter of the second imaginary circle is smaller than the diameter of the first imaginary circle.

According to a fifth feature of the present invention, in addition to any of the first to fourth features, the plurality of fuel injection holes are arranged in the inside region so that they are not on a diameter line of the valve hole passing through a center of the inside region.

The diameter line in the fifth feature corresponds to a first diameter line L1 of the embodiments of the present invention which will be described later.

According to a sixth feature of the present invention, in addition to any of the first to fifth features, the fuel guide member is formed by blanking using a press; and the fuel guide member is joined to the injector plate so that a fracture surface on an outer periphery of the fuel guide member is directed to the valve hole.

With the first feature of the present invention, when the valve assembly is opened, the fuel flow from the valve seat to the valve holes collides with the wall surfaces of the first and second notches of the fuel guide member, and its direction is reversed to the diffusion chamber. The reversed fuel flow from the first notch having a large opening area to the diffusion chamber are divided into a flow which advances in the central portion of the first notch, collides with the outer peripheral wall of the diffusion chamber to be divided into two flows along the outer peripheral wall, and flows which advance along the sidewalls of the closing parts into the outer peripheral sides of the closing parts. The former flow acts on the fuel injection hole in the inside region in the tangential direction, whereby the fuel flows into the fuel injection hole in the inside region while being swirled, and is injected while the fuel particle size is reduced. Therefore, the fuel is formed into an inside spray form having an excellently reduced particle size.

On the other hand, the flow having advanced from the first notch to the outer periphery side of the closing part is weakened because it is greatly resisted by the first tip end corner of the closing part having an edge shape or a minute arc shape. In contrast, almost all the reversed fuel flows from the second notch to the diffusion chamber advance vigorously to the outer peripheral side, namely, the outside region of the closing part along the sidewall of the closing part and the second tip end corner of the closing part, without substantially reducing the flow velocity, because the second notch is relatively small and the second tip end corner of the closing part has a large arc shape. As a result, also in the outside region, the fuel flows into the fuel injection hole while effectively swirling, and is injected while the fuel particle size is reduced. Therefore, the fuel is formed into an outside spray form having an excellently reduced particle size.

Further, because the fuel flow path extending from the valve hole to all the fuel injection holes in the inside and outside regions has a relatively simple shape, the flow suffers a relatively low pressure loss prior to the injection. Therefore, both the inside spray form and the outside spray form have high penetrability, and thus a collective spray form of the inside spray form and the outside spray form also has high penetrability.

With the second feature of the present invention, a strong swirl is given to the fuel flowing into the fuel injection hole in the outside region corresponding to the closing part, thereby effectively reducing the particle size of the injected fuel and improving the penetrability.

With the third feature of the present invention, because the diameter of the first imaginary circle is set to be smaller than the diameter of the second imaginary circle, the opposite sidewalls of the first notch obtain sufficiently long lengths; and also because the first tip end corner of the closing part has the edge or minute arc shape, the opposite sidewalls of the first notch strongly guide the fuel in the radially outward direction and suppress the fuel from advancing to the closing part side. Therefore, the amount of fuel advancing from the second notch to the closing part side is relatively increased. As a result, a swirl is effectively given to the fuel flowing into the fuel injection hole in the outside region.

With the fourth feature of the present invention, because the diameter of the second imaginary circle is set to be smaller than the diameter of the first imaginary circle, the opposite sidewalls of the second notch obtain sufficiently long lengths; and also because the second tip end corner of the closing part has the large arc shape, the opposite sidewalls of the second notch strongly guide the fuel around the closing part. Also in this case, a swirl is effectively given to the fuel flowing into the fuel injection hole in the outside region.

With the fifth feature of the present invention, in the inside region, the plurality of fuel injection holes are arranged not on a diameter line of the valve hole passing through the center of the inside region. Therefore, the fuel flow, which is reversed from the first notch to the diffusion chamber, is divided into two flows in opposite directions from the diameter line along the large-diameter side of peripheral wall of the diffusion chamber, and these flows exert an influence on all the fuel injection holes in the inside region, thereby effectively giving a swirl to the fuel flowing into the fuel injection holes in the inside region.

With the sixth feature of the present invention, the first and second notches obtain large flow path areas by the tapered shaped fracture surface, thereby preventing pressure loss and improving efficiency in fuel injection through the fuel injection holes.

The above-mentioned object, other objects, characteristics, and advantages of the present invention will become apparent from preferred embodiments which will be described in detail below by reference to the attached drawings.

DESCRIPTION OF THE PREFERRED EMBODIMENTS

Figure 1:
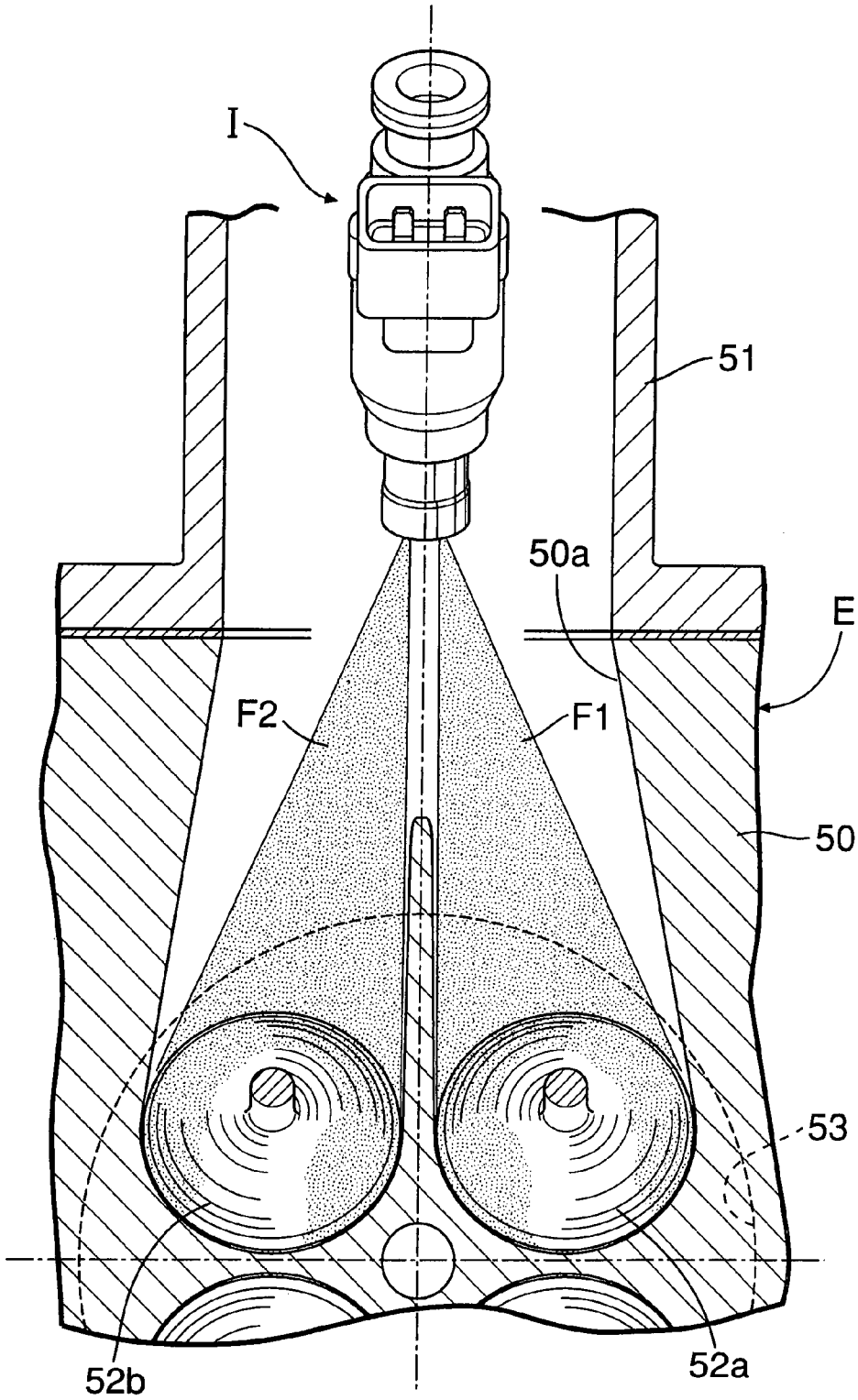
FIG. 1 is a plan view showing a state in which an electromagnetic fuel injection valve according to a first embodiment of the present invention is used in an engine.

In FIG. 1, an engine E has a cylinder head 50 which includes a combustion chamber 53 and an intake port 50*a* that has a downstream end open to the combustion chamber 53. The downstream side of the intake port 50*a* branches off into two which are open to the combustion chamber 53. The pair of openings are opened and closed by a pair of intake valves 52*a* and 52*b*. An intake manifold 51 is joined to one side surface of the cylinder head 50. The interior of the intake manifold 51 communicates with the upstream end of the intake port 50*a*. An electromagnetic fuel injection valve I according to the present invention is mounted to the intake manifold 51. The electromagnetic fuel injection valve I supplies pair of fuel spray forms F1 and F2 toward the two-way downstream ends of the intake port 50*a* when the intake valves 52*a* and 52*b* are open.

Figure 2:
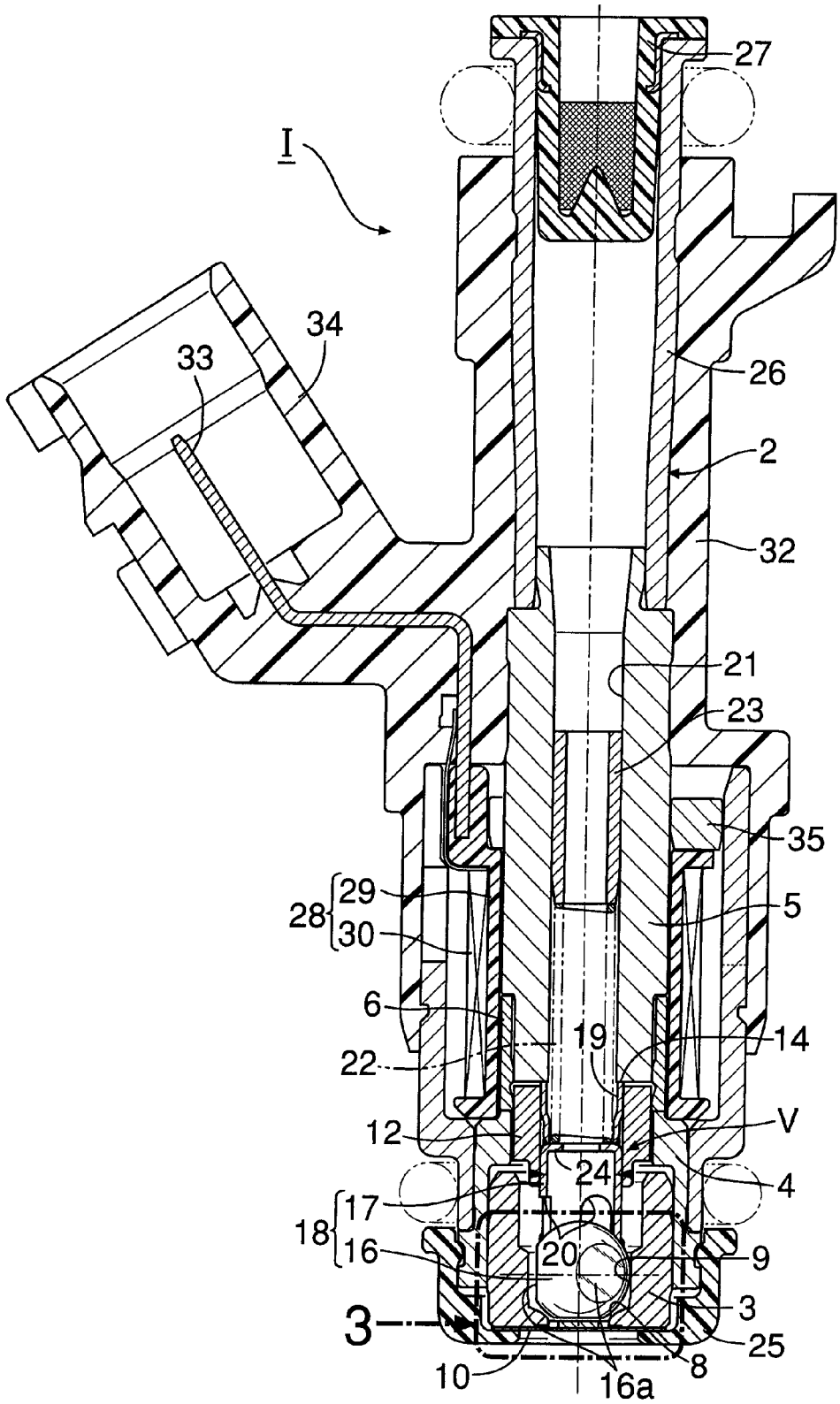
FIG. 2 is a vertical sectional view of the fuel injection valve.
Figure 3:
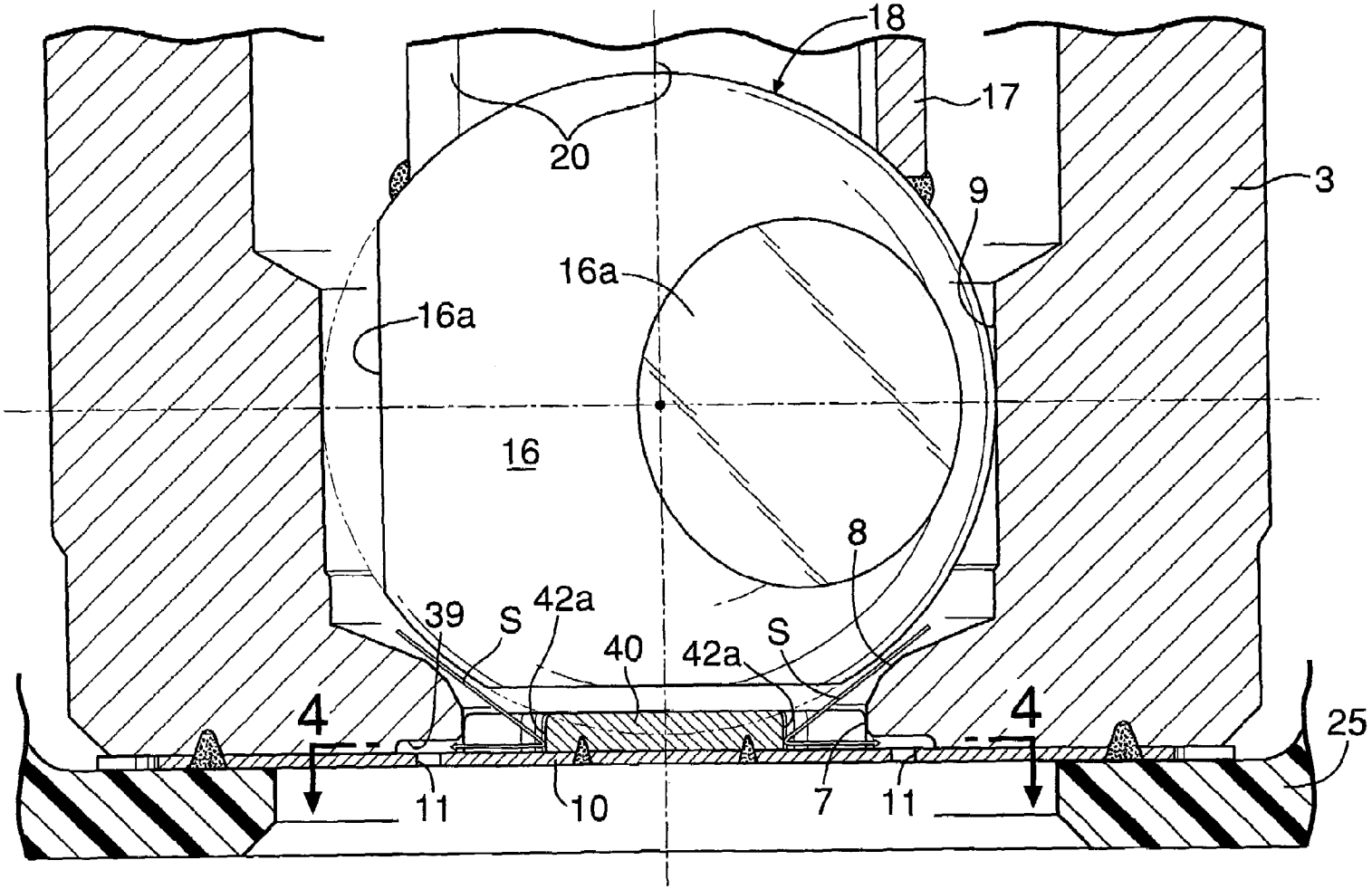
FIG. 3 is an enlarged view of Part 3 of FIG. 2.

In FIGS. 2 and 3, the fuel injection valve I has a valve housing 2 which houses: a cylindrical valve seat member 3; a magnetic cylindrical body 4; a nonmagnetic cylindrical body 6; a fixed core 5; and a fuel inlet cylinder 26. The cylindrical valve seat member 3 has a valve seat 8 at its front end. The magnetic cylindrical body 4 is liquid-tightly connected coaxially to the rear end of the valve seat member 3. The nonmagnetic cylindrical body 6 is liquid-tightly welded coaxially to the rear end of the magnetic cylindrical body 4. The fixed core 5 is liquid-tightly connected coaxially to the rear end of the nonmagnetic cylindrical body 6. The fuel inlet cylinder 26 is connected coaxially to the rear end of the fixed core 5.

The valve seat member 3 has a cylindrical guide hole 9, the conical valve seat 8 connected to the front end of the guide hole 9, and a valve hole 7 penetrating the central portion of the valve seat 8.

The fixed core 5 is liquid-tightly press fitted from the rear end side of the nonmagnetic cylindrical body 6 to the inner peripheral surface of the nonmagnetic cylindrical body 6. Therefore, the nonmagnetic cylindrical body 6 and the fixed core 5 are coaxially connected to each other. In this structure, a portion that does not engage with the fixed core 5 is left at the front end of the nonmagnetic cylindrical body 6. A valve assembly V is housed in the valve housing 2 in a space ranging from such a left portion to the valve seat member 3.

The valve assembly V comprises a valve element 18 and a movable core 12. The valve element 18 includes: a spherical valve part 16 that is slidably engaged with the guide hole 9 to perform opening/closing operation with respect to the valve seat 8; and a hollow rod part 17 for supporting the valve part 16. The movable core 12 is welded to the rod part 17, slidably fitted to the inner peripheral surface of the magnetic cylindrical body 4, and positioned so as to be coaxially opposed to the fixed core 5.

The valve assembly V comprises a longitudinal hole 19, a plurality of transverse holes 20, and a plurality of chamfer parts 16*a*. The longitudinal hole 19 extends from the rear end face of the movable core 12 and terminates at a position in front of the valve part 16. The transverse holes 20 connect the longitudinal hole 19 to the outer peripheral surface of the rod part 17. The chamfer parts 16*a* are formed on the outer peripheral surface of the valve part 16 and connected to the transverse holes 20. An annular spring seat 24 comprising an end wall of the rod part 17 is formed in the middle of the longitudinal hole 19.

The fixed core 5 has in its central portion a longitudinal hole 21 communicating with the longitudinal hole 19 of the valve assembly V. A valve spring 22 is provided under compression between the spring seat 24 and a pipe-shaped retainer 23 that is press-fitted and fixed into the longitudinal hole 21. Therefore, the valve assembly V is urged in the direction in which the valve part 16 seats on the valve seat 8. A cylindrical stopper member 14 having a high hardness is fixed to the inner peripheral surface of the movable core 12 so as to surround the valve spring 22. The outer end of the stopper member 14 slightly projects from the attraction surface of the movable core 12. The stopper member 14 is generally disposed so as to be opposed to the attraction surface of the fixed core 5 with a gap corresponding to the valve opening stroke of the valve assembly V provided therebetween.

The fuel inlet cylinder 26 is liquid-tightly fitted and welded to the outer peripheral surface of the rear end of the fixed core 5. A fuel filter 27 is mounted to the inlet of the fuel inlet cylinder 26.

A coil assembly 28 is fittingly mounted to the outer periphery of the valve housing 2 corresponding to the fixed core 5 and the movable core 12. The coil assembly 28 comprises: a bobbin 29 fitted to the outer peripheral surfaces of the magnetic cylindrical body 4 and the fixed core 5 so as to extend from the rear end of the magnetic cylindrical body 4 to the fixed core 5; and a coil 30 wound around the bobbin 29. A coil housing 31 surrounds the coil assembly 28. The front end of the coil housing 31 is welded to the outer peripheral surface of the magnetic cylindrical body 4. An annular yoke 35 is fitted and welded to the inner peripheral surface of the rear end of the coil housing 31 and the outer peripheral surface of the fixed core 5.

The coil housing 31, the coil assembly 28, the fixed core 5, and the fuel inlet cylinder 26 are embedded in a synthetic resin cylindrical mold part 32. A coupler 34 is integrally formed at an intermediate portion of the mold part 32 so as to project to one side. The coupler 34 holds an energizing terminal 34 connected to the coil 30.

An injector plate 10 is annularly joined by laser welding to the front end surface of the valve seat member 3. A protective cap 25 is fitted to the magnetic cylindrical body 4 so as to cover the outer peripheral portion of the front surface of the injector plate 10.

Figure 4:
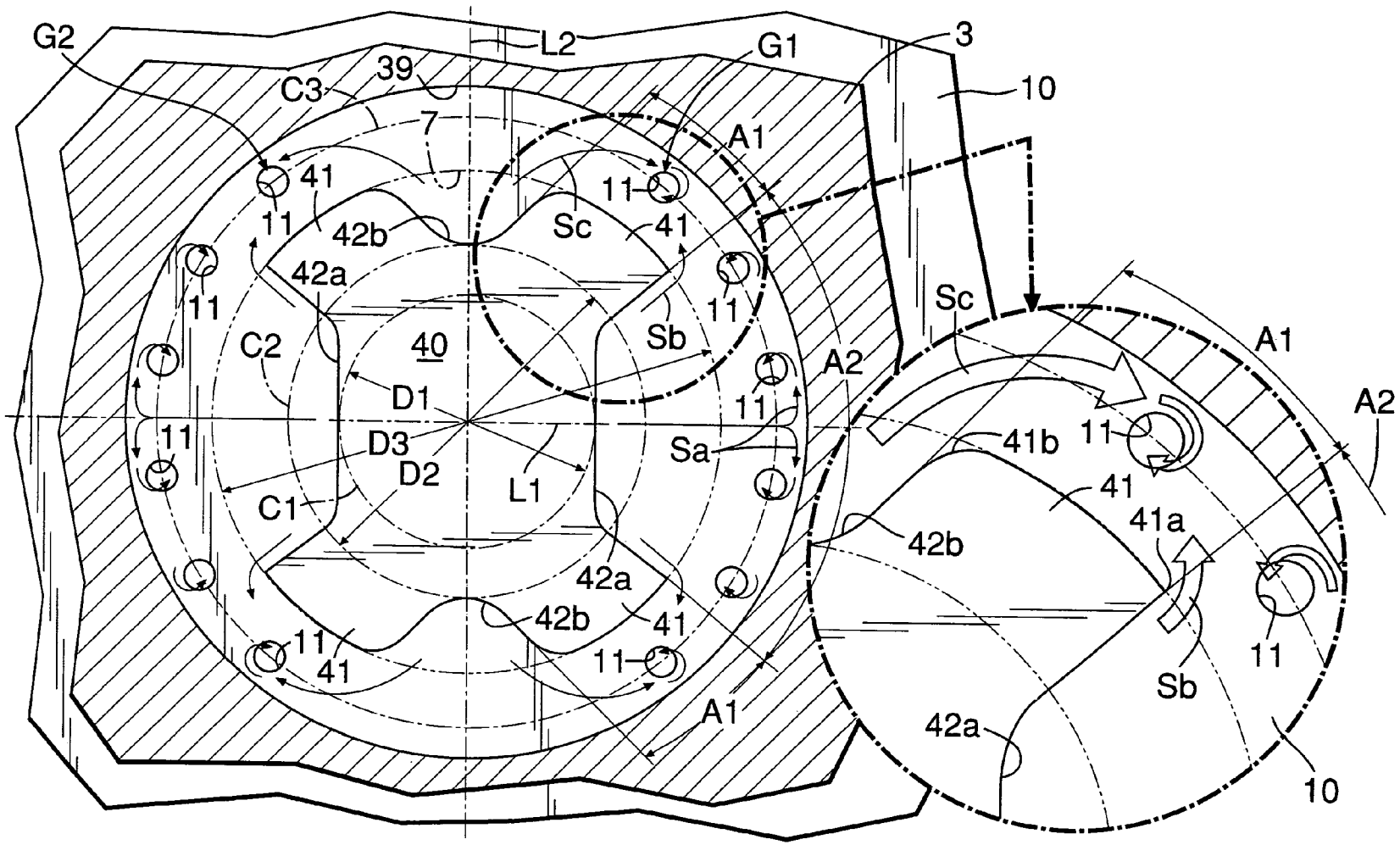
FIG. 4 is a sectional view taken along a line 4-4 of FIG. 3.
Figure 5:
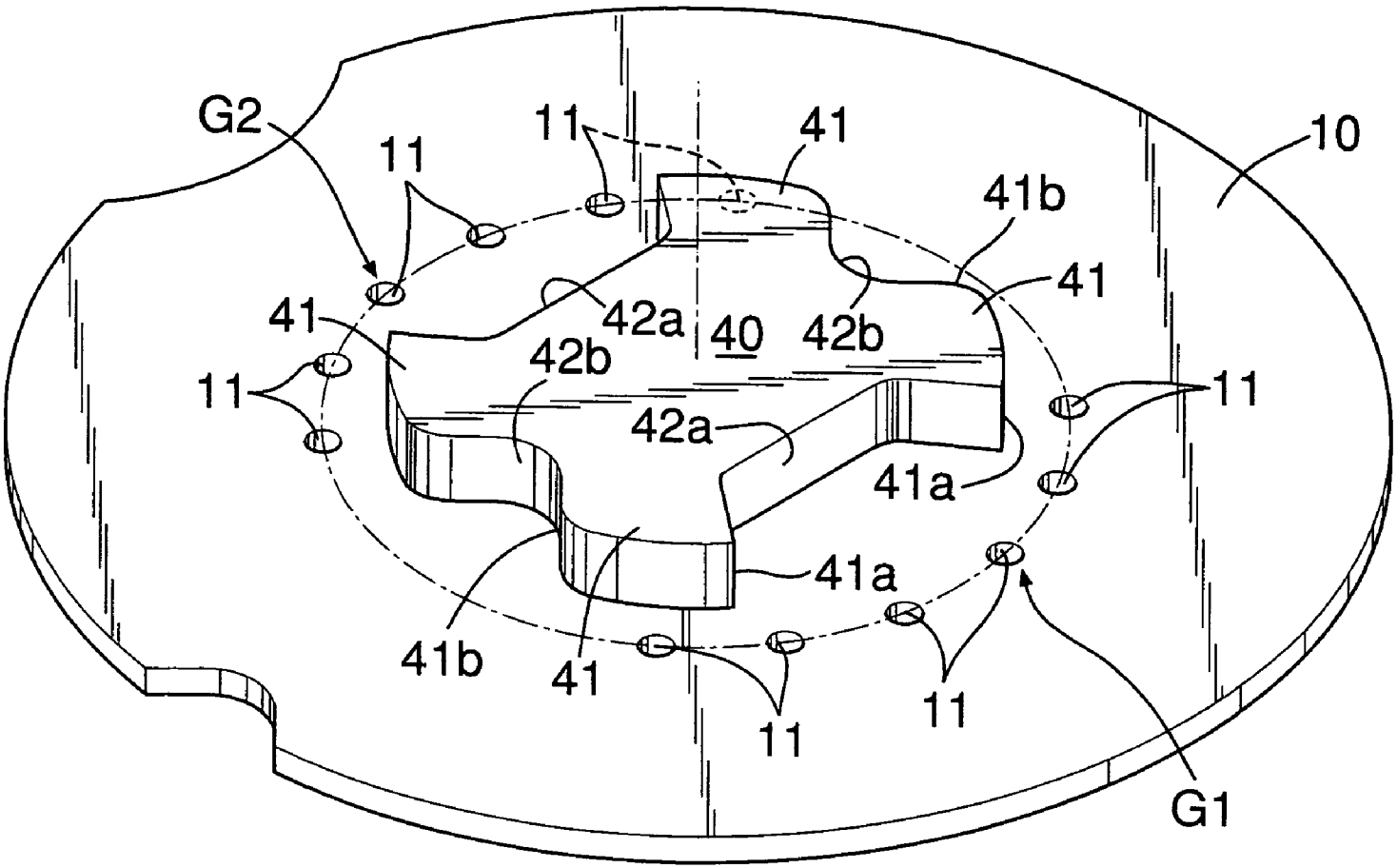
FIG. 5 is a perspective view showing a state in which a fuel guide member is joined to an injector plate in the fuel injection valve.

As shown in FIGS. 3 to 5, a fuel guide member 40 fitted in the valve hole 7 is annularly joined by laser welding to the central portion of the injector plate 10. In the outer periphery of the fuel guide member 40, an annular diffusion chamber 39 having a diameter larger than that of the valve hole 7 is defined between the valve seat member 3 and the injector plate 10. Therefore, the outer peripheral wall of the diffusion chamber 39 comprises the valve seat member 3, and the inner peripheral wall thereof comprises the fuel guide member 40.

A pair of first notches 42*a*, a pair of second notches 42*b*, and a plurality of closing parts 41 are formed in the outer periphery of the fuel guide member 40. The first notches 42*a* have large notch areas, and are opened in arcuate shapes in directions opposite from each other on a first diameter line L1 of the valve hole 7, thereby providing a communication between the valve hole 7 and the diffusion chamber 39. The second notches 42*b* have small notch areas, and are opened in arcuate shapes in directions opposite from each other on a second diameter line L2 perpendicular to the first diameter line L1 of the valve hole 7, thereby providing a communication between the valve hole 7 and the diffusion chamber 39. The closing parts 41 are provided between the first and second notches 42*a* and 42*b* to partially close the valve hole 7. In this structure, the first notches 42*a* are arranged so as to circumscribe a first imaginary circle C1 concentric with the valve hole 7, and the second notches 42*b* are arranged so as to circumscribe a second imaginary circle C2 concentric with the first imaginary circle C1.

A first tip end corner 41*a* of the closing part 41 adjacent to the first notch 42*a* is formed into an edge shape or a minute arc shape, while a second tip end corner 41*b* of the closing part 41 adjacent to the second notch 42*b* is formed into a large arc shape having a curvature smaller than that of the first tip end corner 41*a*.

A plurality of fuel injection holes 11 are formed in the injector plate 10 so as to open to the diffusion chamber 39. The fuel injection holes 11 are formed to be parallel with the axis of the valve seat member 3, and are arranged on a third imaginary circle C3 which has a diameter larger than that of the second imaginary circle C2 and which is concentric with the second imaginary circle C2. The fuel injection holes 11 are divided into two groups G1 and G2 arranged symmetrically with respect to the second diameter line L2. The plurality of fuel injection holes 11 of each of the groups G1 and G2 are dispersally arranged in regions A1 corresponding to the closing parts 41 and an inside region A2 corresponding to the first notch 42*a*. However, in the case where the plurality of fuel injection holes 11 are arranged in the inside region A2 corresponding to the first notch 42*a*, they are dispersally arranged on opposite sides of the first diameter line L1 so as not to be positioned on the line L1.

Figure 7:
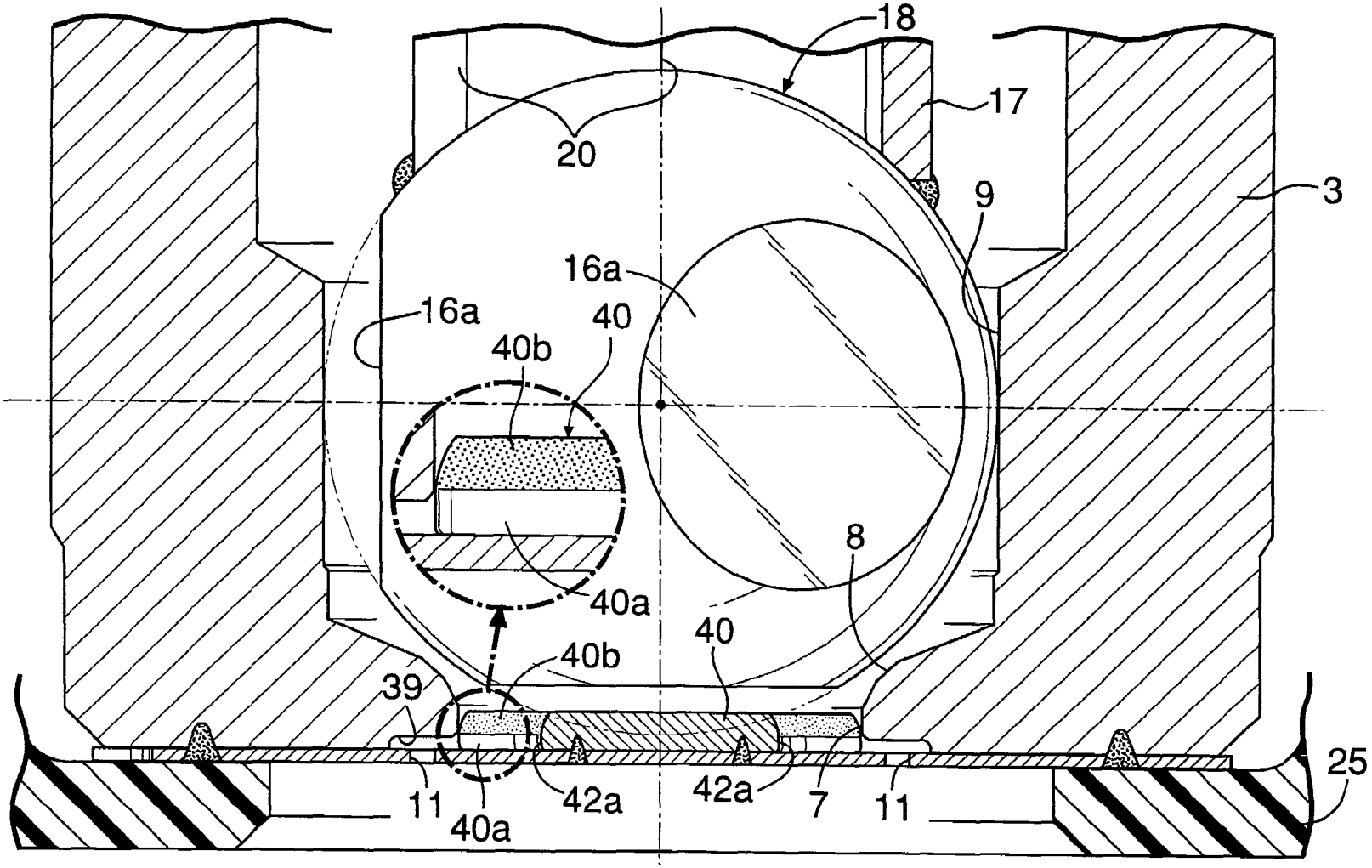
FIG. 7 is a view for explaining a structure in which the fuel guide member is joined to the injector plate.

As shown in FIG. 7, the fuel guide member 40 is blanked by the cooperation of a die and a punch which are attached to a pressing machine. A fracture surface 40*b* on the punch side and a shearing surface 40*a* on the opposite side from the punch side are formed in the outer periphery of the fuel guide member 40. The fracture surface 40*b* has a taper shape such that its diameter decreases toward its outer end. The fuel guide member 40 is joined to the injector plate 10 by laser welding such that the fracture surface 40*b* side is directed to the valve hole 7. With this structure, the first and second notches 42*a* and 42*b* obtain large flow path areas by the taper-shaped fracture surface 40*b*. This structure is effective in preventing pressure loss and improving efficiency in fuel injection through the fuel injection holes 11.

Next, the operation of this embodiment is described.

In the state in which the coil 30 is de-energized, the valve assembly V is pressed forward by the urging force of the valve spring 22, so that the valve element 18 is seated on the valve seat 8. In this state, the fuel supplied under pressure from an unillustrated fuel pump to the fuel inlet cylinder 26 passes through the interior of the pipe-shaped retainer 23, and the longitudinal hole 19 and the transverse hole 20 in the valve assembly V, and is allowed to stand by in the valve seat member 3.

When the coil is energized by supply of a current, a magnetic flux produced by the energization sequentially runs through the fixed core 5, the coil housing 31, the magnetic cylindrical body 4, and the movable core 12; the magnetic force causes the movable core 12 of the valve assembly V to be attracted to the fixed core 5 against the set load of the valve spring 22; and the valve part 16 of the valve element 18 is separated from the valve seat 8 of the valve seat member 3 as shown in FIG. 3. Therefore, a main flow S of high-pressure fuel in the valve seat member 3 advances to the valve hole 7 side along the valve seat 8, collides with the wall surfaces of the first and second notches 42*a* and 42*b* of the fuel guide member 40, and its direction is reversed to the diffusion chamber 39 side.

Because the first notch 42*a* is relatively large, the reversed fuel flow from the first notch 42*a* to the diffusion chamber 39 advances in the central portion of the first notch 42*a*, and collides with the outer peripheral wall of the diffusion chamber 39 to be divided into flows Sa, Sa parting to opposite sides on the first diameter line L1; or advances along the sidewall of the closing part 41 to the outer periphery side of the closing part 41 to become a flow Sb.

The fuel flows Sa and Sa parting to the opposite sides of the first diameter line L1 upon collision with the outer peripheral wall of the diffusion chamber 39 act on the fuel injection holes 11 in the inside region A2 in the tangential direction. Thus, the fuel flows into the fuel injection holes 11 in the inside region A2 while being swirled, and is injected while the fuel particle size is reduced, thereby forming an inside spray form fb having an excellently reduced fuel particle size.

On the other hand, the flow Sb advancing to the outer periphery side of the closing part 41 is greatly resisted by the first tip end corner 40*a* having an edge shape or a minute arc shape, and is weakened by the occurrence of separation and vortexes.

In contrast, almost all the reversed flows Sc from the second notch 42*b* to the diffusion chamber 39 advance vigorously to the outer periphery side, namely, the outside region A1 of the closing part 41 along the sidewall and the second tip end corner 41*b* of the closing part 41, without substantially reducing the flow velocity, because the second notch 42*b* is relatively small and the second tip end corner 41*b* of the closing part 41 has a large arc shape. As a result, also in the outer peripheral side of the closing part 41, namely, the outside region A1, there are generated the strong fuel flow Sc from the second notch 42*b* and the weak fuel flow Sb from the first notch 42*a* around the fuel injection hole 11. Therefore, also in the outside region A1, the fuel flows into the fuel injection hole 11 while effectively swirling, and is injected while the fuel particle size is reduced. Thus, the fuel is formed into an outside spray form fa having an excellently reduced fuel particle size.

Further, because the fuel flow path extending from the valve hole 7 to all the fuel injection holes 11 in the inside and outside regions A1 and A2 has a relatively simple shape, the flow suffers a relatively low pressure loss prior to the injection. Therefore, both the inside spray form fa and the outside spray form fb have high penetrability.

Figure 6:
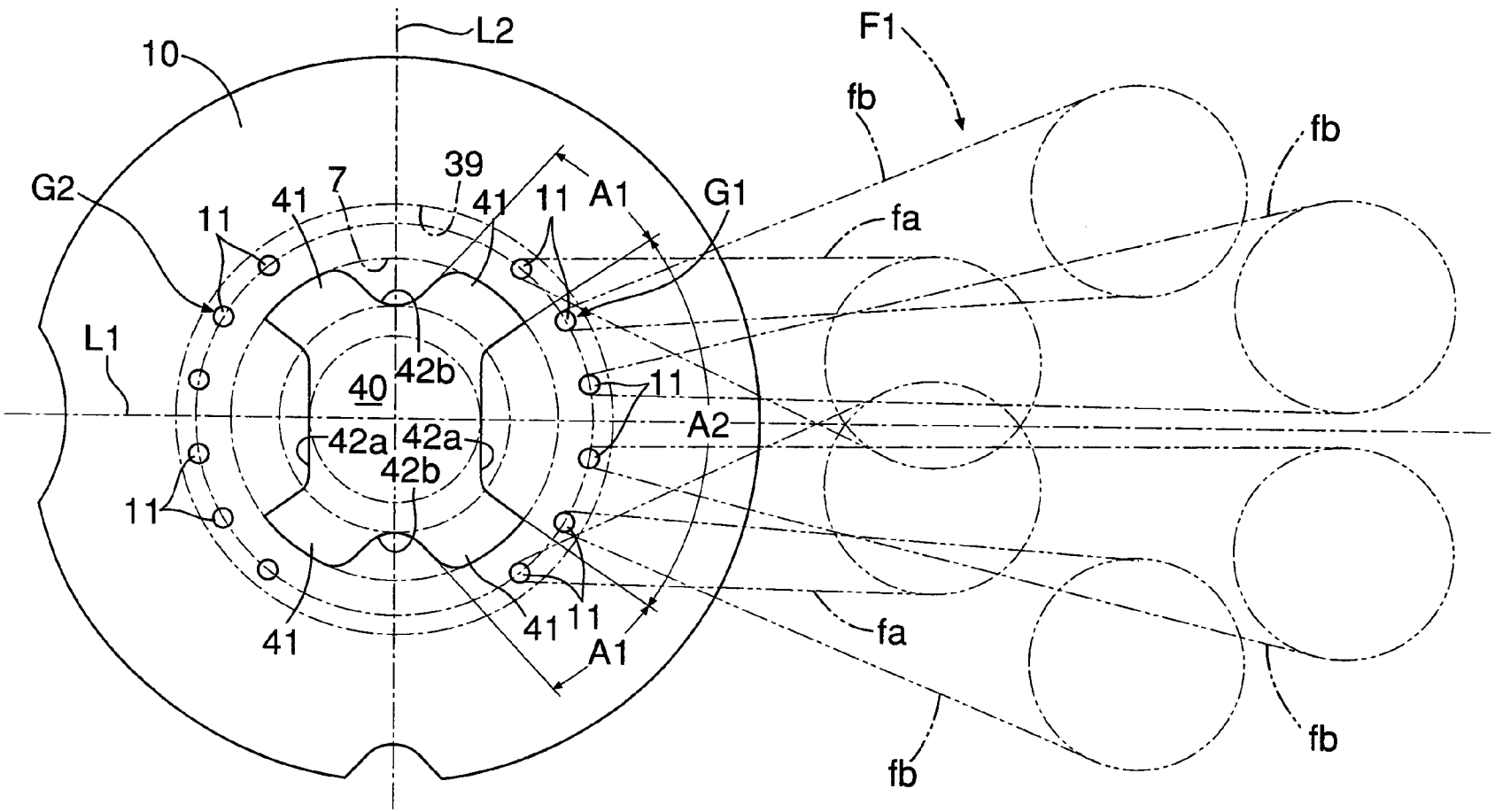
FIG. 6 is a view for explaining formation of a fuel spray form by fuel injected through the fuel injection valve.

Thus, as shown in FIGS. 1 and 6, a pair of symmetrical collective spray forms F1 and F2 (only one collective spray form F1 is shown in FIG. 6) are formed on the opposite sides of the second diameter line L2 respectively comprising the inside spray form fb and the outside spray form fa. Also, these collective spray forms F1 and F2 have excellently reduced fuel particle size and high penetrability.

Further, in the inside region A2 corresponding to the first notch 42*a*, the plurality of fuel injection holes 11 are dispersally arranged on the opposite sides of the first diameter line L1 so as not to be on the first diameter line L1. Therefore, the flows Sa, Sa parting to the opposite sides of the first diameter line L1 along the large-diameter side peripheral wall of the diffusion chamber 39 exert an influence on all the fuel injection holes 11 in the inside region A2, thereby effectively giving a swirl to the fuel flowing into the fuel injection holes 11 in the inside region A2.

An actual test revealed that when the diameter of the first imaginary circle C1 circumscribed with the first notch 42*a* represents D1, the diameter of the second imaginary circle C2 circumscribed with the second notch 42*b* represents D2, and the outer diameter of the fuel guide member 40 represents D3, the dimensional relationship of these diameters influences the swirl force of fuel flowing into the fuel injection hole 11 in the outside region A1.

Figure 9:
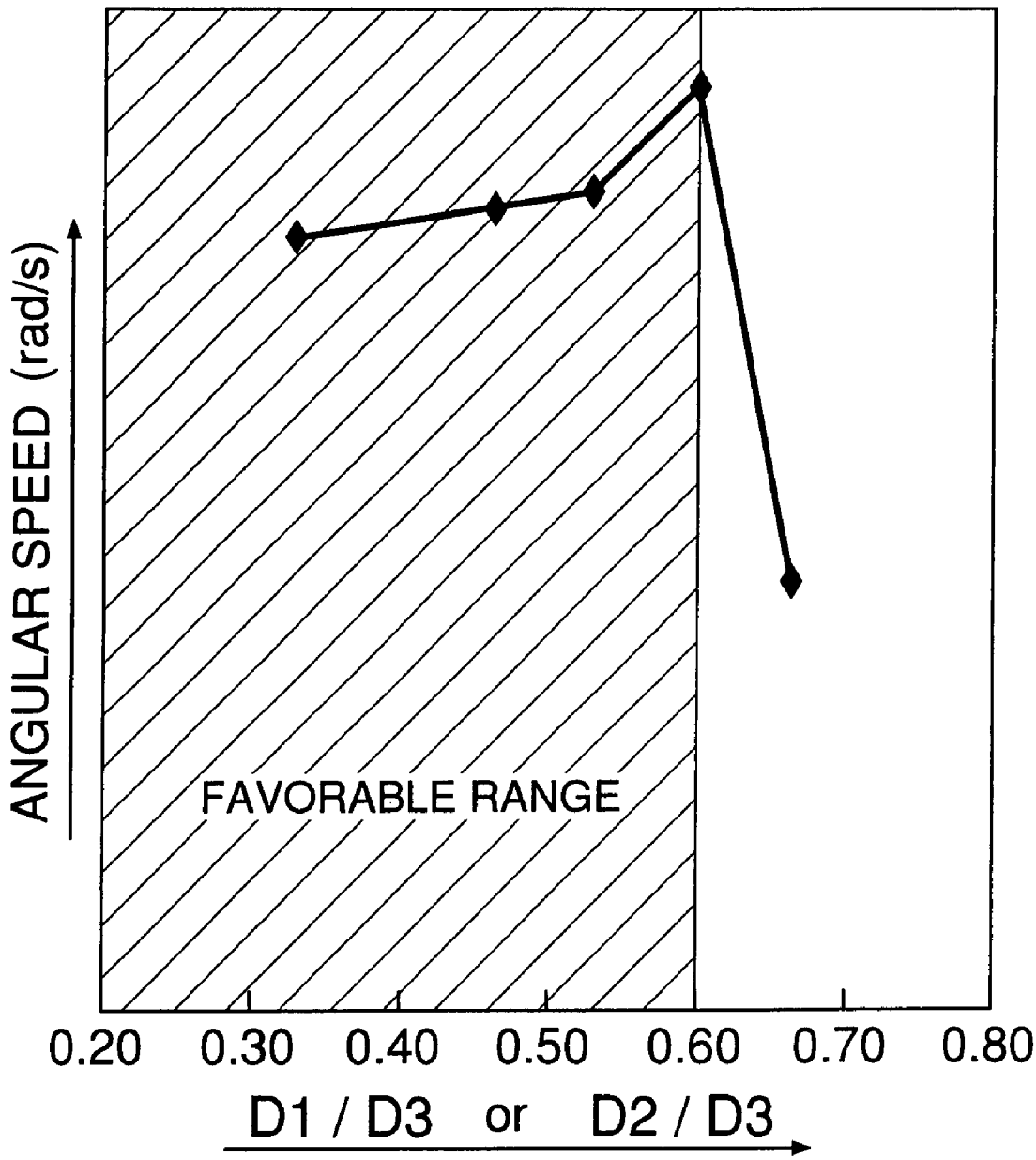
FIG. 9 is a graph established on test results and showing relation in a fuel guide member between ratio of D1/D3 or D2/D3 and swirl angular velocity of fuel flowing into a fuel injection hole in an outside region.

First, the change in angular velocity of swirl of the in-flow fuel was observed while changing the value of D1/D3 or D2/D3. As shown in FIG. 9, as the value of D1/D3 or D2/D3 changed from 0.3 to 0.6, the angular velocity of swirl of the in-flow fuel increased, and when the value exceeds 0.6, the angular velocity suddenly decreased. Therefore, it is important in enhancing the swirl force of the in-flow fuel to satisfy Equation (1): $D1/D3 \text{ or } D2/D3 \leqq 0.6$.

Figure 10:
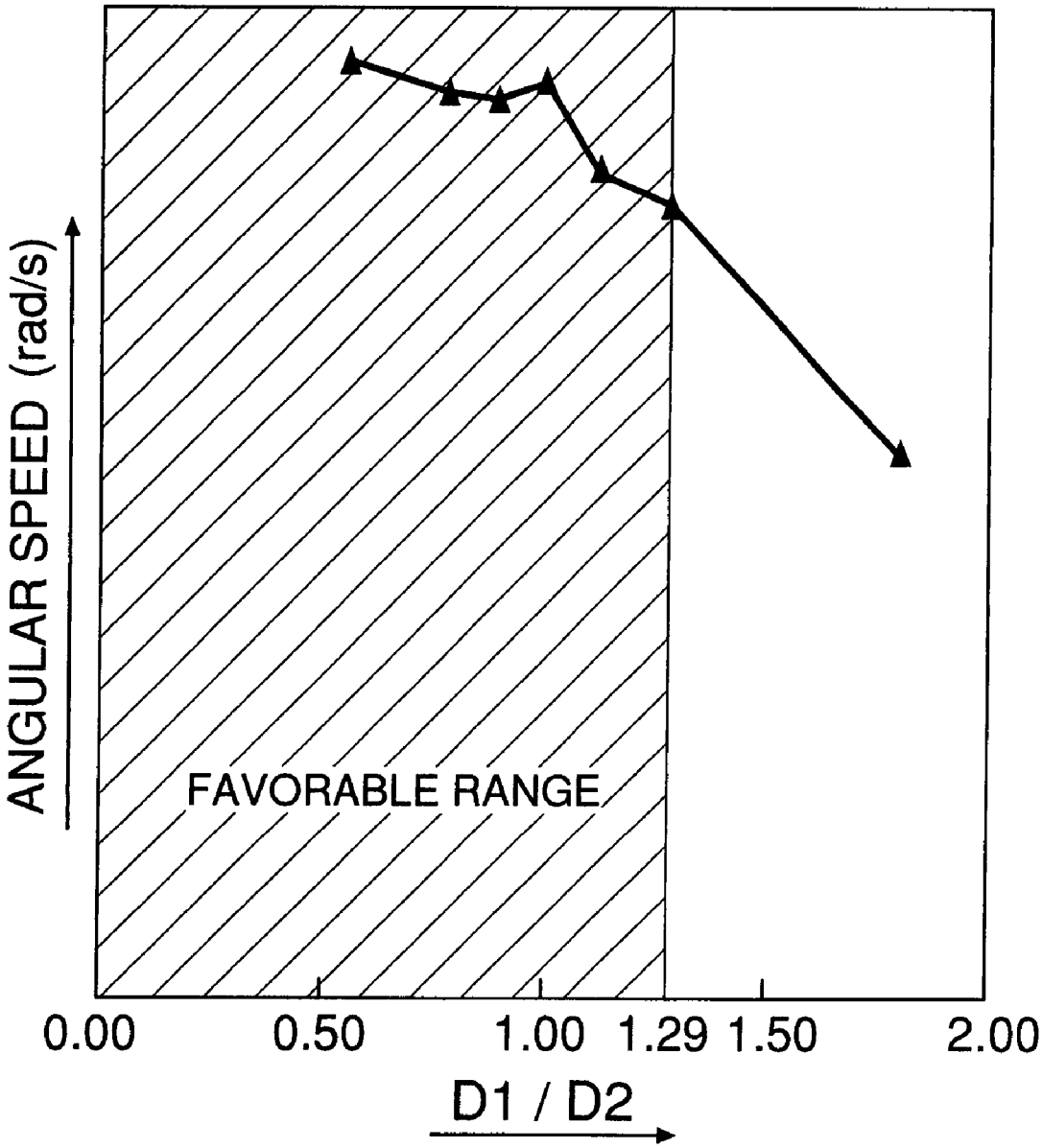
FIG. 10 is a graph established on test results and showing relation between ratio of D1/D2 and swirl angular velocity of fuel flowing into a fuel injection hole in the outside region.

Next, the change in angular velocity of swirl of the in-flow fuel was observed while changing the value of D1/D2. As shown in FIG. 10, as the value of D1/D2 changed from 0.5 to 1.29, the angular velocity of swirl of the in-flow fuel gradually decreased, and when the value exceeds 1.29, the angular velocity suddenly decreased. Therefore, it is also important in enhancing the swirl force of the in-flow fuel to satisfy Equation (2): $D1/D2 \leqq 1.29$.

As is apparent from Equation (2), the dimensional relationship between D1 and D2 does not matter as long as Equation (2) is satisfied. Specifically, in the case where $D1 < D2$ as shown in FIG. 4 (in the case where the diameter of the first imaginary circle C1 circumscribed with the first notch 42*a* is smaller than the diameter of the second imaginary circle C2 circumscribed with the second notch 42*b*), both the sidewalls of the first notch 42*a* obtain sufficiently large lengths. Also because the first tip end corner 41*a* of the closing part 41 has the edge or minute arc shape, the opposite sidewalls of the first notch 42*a* strongly guide the fuel in the radially outward direction and suppress the fuel from advancing to the closing part side. Therefore, the amount of fuel advancing from the second notch 42*b* to the closing part 41 side is relatively increased. As a result, a swirl is effectively given to the fuel flowing into the fuel injection hole 11 in the outside region A1.

Figure 8:
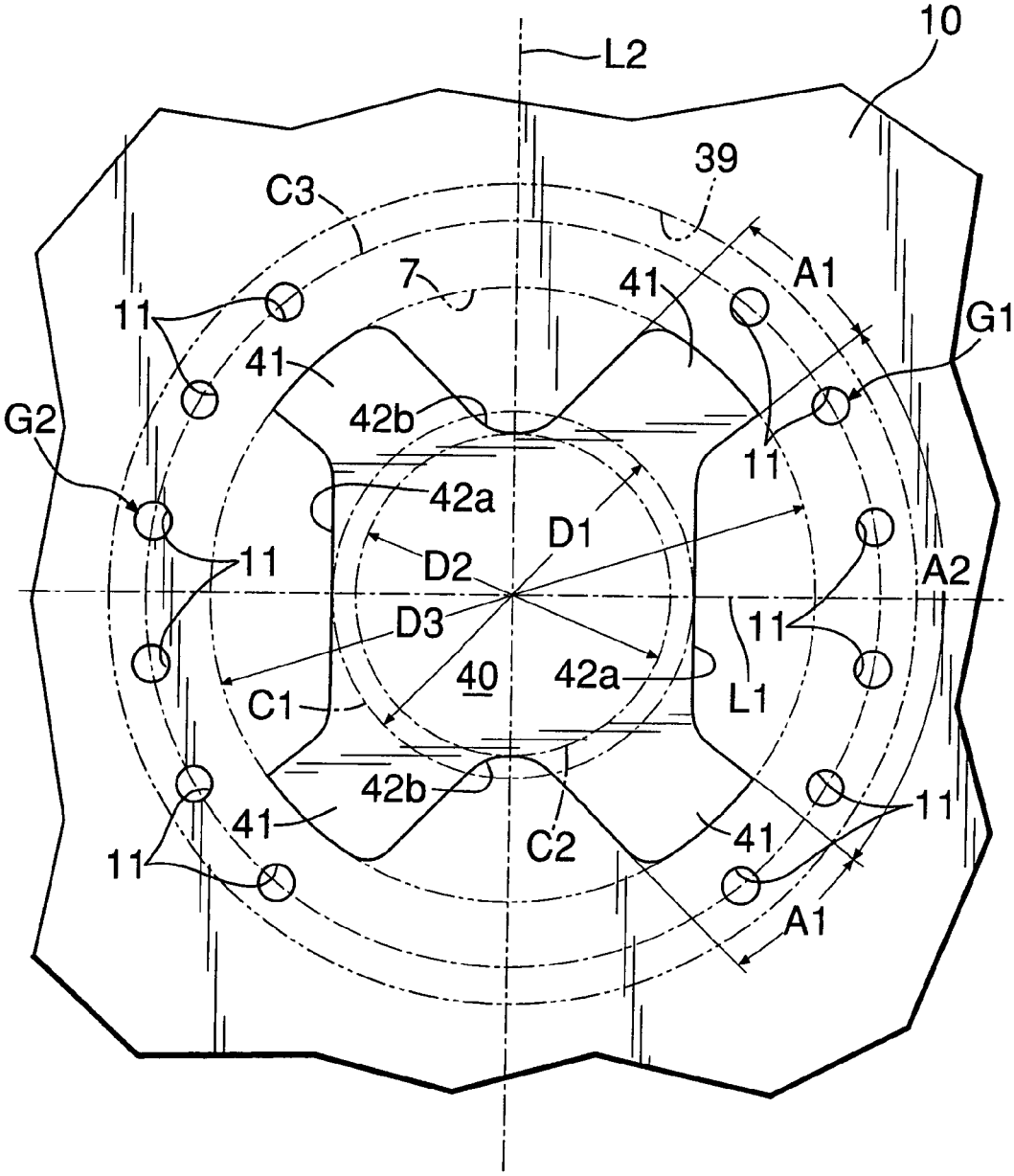
FIG. 8 is a corresponding view with FIG. 4, but showing a second embodiment of the present invention.

Also, in contrast to the above description, in the case where D2<D1 as shown in FIG. 8 (in the case where the diameter of the second imaginary circle C2 circumscribed with the second notch 42*b* is smaller than the diameter of the first imaginary circle C1 circumscribed with the first notch 42*a*), both the sidewalls of the second notch 42*b* obtain sufficiently large lengths. Also because the second tip end corner 41*b* of the closing part 41 has the large arc shape, the opposite sidewalls of the second notch 42*b* strongly guide the fuel to the closing part 41 side. Also in this case, a swirl is effectively given to the fuel flowing into the fuel injection hole 11 in the outside region A1.

The present invention is not limited to the above-described embodiment, and various changes in design can be made without departing from the subject matter of the present invention. For example, the fuel injection hole 11 in each group G1, G2 may be tilted within a range of 5 to 15° with respect to the axis the valve seat member 3, corresponding to inclination of the fuel spray forms F1 and F2 required with respect to the axis of the valve seat member 3.

What is claimed is:

1. A fuel injection valve comprising:

a valve seat member which includes:

a conical valve seat; and a valve hole penetrating a central portion of the valve seat;

a valve element for opening and closing the valve hole in cooperation with the valve seat;

an injector plate which has a plurality of fuel injection holes arranged so as to be displaced radially outward of the valve hole and which is joined to the valve seat member; and a diffusion chamber provided between the valve seat member and the injector plate so as to provide a communication between the valve hole and the fuel injection holes, wherein a fuel guide member facing the valve hole is connected to a central portion of the injector plate;

the annular diffusion chamber has a diameter larger than that of the valve hole and is formed between the valve seat member and the injector plate, inner ends of the fuel injection holes being opened in the annular diffusion chamber, an outer peripheral surface of the fuel guide member facing the annular diffusion chamber;

a pair of first notches, a pair of second notches, and a plurality of closing parts are formed in an outer periphery of the fuel guide member, the first notches having large notch areas and being opened in directions opposite from each other to provide a communication between the valve hole and the diffusion chamber, the second notches having small notch areas and being opened in directions opposite from each other on a diameter line passing between the pair of first notches to provide a communication between the valve hole and the diffusion chamber, the closing parts being provided between the first and second notches to partially close the valve hole;

the plurality of fuel injection holes are divided into two groups arranged on opposite sides of the diameter line, and the plurality of fuel injection holes of each group are dispersally arranged in outside regions corresponding to the closing parts and an inside region corresponding to the first notch;

a first tip end corner of the closing part adjacent to the first notch is formed into an edge shape or a minute arc shape, and a second tip end corner of the closing part adjacent to the second notch is formed into a large arc shape having a curvature smaller than that of the first tip end corner.

2. The fuel injection valve according to claim 1, wherein the pair of first notches are arranged so as to circumscribe a first imaginary circle concentric with the valve hole; the pair of second notches are arranged so as to circumscribe a second imaginary circle concentric with the first imaginary circle; and when a diameter of the first imaginary circle represents D1, a diameter of the second imaginary circle represents D2, and an outer diameter of the fuel guide member represents D3, the following two equations are established at the same time:

$$D1/D3 \text{ or } D2/D3 \leqq 0.6; \text{ and} \quad (1)$$

$$D1/D2 \leqq 1.29 \quad (2).$$

3. The fuel injection valve according to claim 2, wherein the diameter of the first imaginary circle is smaller than the diameter of the second imaginary circle.

4. The fuel injection valve according to claim 2, wherein the diameter of the second imaginary circle is smaller than the diameter of the first imaginary circle.

5. The fuel injection valve according to any one of claims 1 to 4, wherein the plurality of fuel injection holes are arranged in the inside region so that they are not on a diameter line of the valve hole passing through a center of the inside region.

6. The fuel injection valve according to any one of claims 1 to 4, wherein the fuel guide member is formed by blanking using a press; and the fuel guide member is joined to the injector plate so that a fracture surface on an outer periphery of the fuel guide member is directed to the valve hole.

7. The fuel injection valve according to claim 5, wherein the fuel guide member is formed by blanking using a press; and the fuel guide member is joined to the injector plate so that a fracture surface on an outer periphery of the fuel guide member is directed to the valve hole.

* * * * *